US005456198A

United States Patent [19]

Smedal et al.

[11] Patent Number: 5,456,198

[45] Date of Patent: Oct. 10, 1995

[54] VESSEL HULL HAVING COMPOSITE SKIN PLATE PROVIDED WITH DIAPHRAMIC INNER SKIN FOR PRIMARY RESISTANCE TO EXTERNALLY APPLIED FLUID PRESSURE

[75] Inventors: Arne Smedal, Færvik; Vidar Holmøy; Kåre Syvertsen, both of Arendal, all of Norway

[73] Assignee: MCG A/S, Arendal, Norway

[21] Appl. No.: 199,323

[22] PCT Filed: Sep. 2, 1992

[86] PCT No.: PCT/NO92/00139

§ 371 Date: Jun. 28, 1994

§ 102(e) Date: Jun. 28, 1994

[87] PCT Pub. No.: WO93/04911

PCT Pub. Date: Mar. 18, 1993

[30] Foreign Application Priority Data

Sep. 3, 1991 [NO] Norway ..... 913455

[51] Int. Cl.[6] ..... B63B 1/00

[52] U.S. Cl. ..... 114/65 R; 114/74 A

[58] Field of Search ..... 114/56, 355, 65 R, 114/69, 74 A, 79 R, 80, 84

[56] References Cited

U.S. PATENT DOCUMENTS 1,289,760 12/1918 Hirota ..... 114/69
4,638,754 1/1987 Tornay .

FOREIGN PATENT DOCUMENTS 2116254 7/1972 France .
20479 of 1913 United Kingdom ..... 114/80

OTHER PUBLICATIONS

WO, A1, 9109768 (Sinvent AS) 11 Jul. 1991, see the whole document.

*Primary Examiner*—Jesus D. Sotelo
*Attorney, Agent, or Firm*—Cushman, Darby & Cushman

[57] ABSTRACT

In a hull the skin plate is built up as a composite member with an outer skin, a core and an inner skin. The skin plate is placed on the framework which includes longitudinal stiffeners. The inner skin is constructed as a diaphragm element relative to the external water pressure, while the core is made as a pressure-absorbing element and the outer skin is constructed primarily as a bending stressed element. The inner skin as a diaphragm will take tensile stress and be protected against outer local stresses. The material in the core can be chosen without major requirements to be able to tolerate shearing stress. The outer skin can be dimensioned and made primarily to take local shock loads.

5 Claims, 1 Drawing Sheet

VESSEL HULL HAVING COMPOSITE SKIN PLATE PROVIDED WITH DIAPHRAMIC INNER SKIN FOR PRIMARY RESISTANCE TO EXTERNALLY APPLIED FLUID PRESSURE

BACKGROUND OF THE INVENTION

The present invention relates to an arrangement for the hull of a vessel, wherein a skin plate is placed upon longitudinal stiffeners in a stiffening framework, said skin plate being built up as a composite member having an outer skin, a core and an inner skin, wherein the skin plate is designed to take external water pressure by making use of a diaphragm effect.

In this document, the term skin plate shall be understood to mean a plate area between two adjacent longitudinal stiffeners, and also a larger area composed of several skin plates of this kind which are connected to one another.

In a traditional hull, the construction of the plate and stiffener system is formed in such a way that the plates primarily bear the bending stress. The forces are fed from the plates over into the primary stiffeners (usually longitudinal stiffeners) and further over into the secondary stiffeners (usually the transverse stiffeners) and out into the side of the ship/longitudinal bulkhead in order to be distributed along the "ship's beam". In small vessels, the skin plate is often provided with a double-curved form. This contributes to outer pressure forces being taken up primarily as compressive stress (shell effect).

A hull built according to the traditional design can be optimalized with regard to weight or with regard to the cost of production. An optimal weight construction is characterized by relatively thin skin plates and a compact framework of primary and secondary stiffeners. This results in a complicated construction with high production costs. This complicated construction introduces several problems. In steel and aluminum hulls, as well as in glass fiber ones, a series of complicated connections between the different stiffening components is introduced. Cracking may easily occur here due to fatigue or delamination.

All the components of the hull are usually dimensioned so that the level of stress lies below a permitted elastic tension. When the plate sections are subjected to overloading, local deformation will occur at the points of attachment to the stiffeners and forces in the plates will gradually go from bending stress to tensile stress (diaphragm stress). This gives rise to lasting deformation (buckling) in metal hulls and local cracking in glass fiber hulls.

Constructions of hulls have been proposed with a view to making possible a reduction in weight and costs. Thus, for a metal hull, the use of a diaphragm effect is suggested in U.S. Pat. No. 4,638,754, wherein the plates are provided with a concave curvature when seen from the outside. Similarly, the use of a diaphragm has been suggested for skin plates built up as composite elements or so-called sandwich elements, having an outer skin, a core and an inner skin which are laminated together. In this connection, reference shall be made to International Patent Application No. PCT/NO90/00188 wherein skin plates are suggested which are concave when seen from the outside. The skin plates are built up as laminated elements and so-called diaphragm sections are obtained with the proposed concave form, i.e., concave plate sections which bear outer pressure with tensile stress. One disadvantage with this known construction is that it places demands on the geometry of the outer hull. In addition, with the manner of construction as described in PCT/NO90/00188 certain demands are made on the shearing strength in the core material.

SUMMARY OF THE INVENTION

In spite of the disadvantages, this last-mentioned concept represents technical advancement, and the object of the invention is to provide measures which eliminate, or greatly reduce, the disadvantages, using the prior art as a basis. One particular object of the invention is to form the skin plate so that the desired diaphragm effect can be sustained even though the outer skin provides a smooth hull form and even when there is overloading which results in shearing fractures/local buckling in the known embodiment. More closely defined, this is achieved by the skin plate being built-up in such a way that the diaphragm effect-providing element is protected in the best way possible against outer stress, while the core material is incorporated in the skin plate in such a way that the danger of shearing fractures in the core material is greatly reduced.

According to the invention, therefore, an arrangement is provided for the hull of a vessel wherein a skin plate is placed on longitudinal stiffeners in a stiffening framework, the skin plate being built up as a composite element having an outer skin, a core and an inner skin, the skin plate being designed to take external water pressure by making use of the diaphragm effect, the arrangement according to the invention being characterized in that only the inner skin is constructed as a diaphragm element relative to the external water pressure, while the core and the outer skin are constructed as a pressure receptive element and a primary lateral stressed element which is directly supported by the core, respectively.

By means of the invention one attains a situation wherein outer loads (distributed pressure) will be borne by tensile stress in the inner skin which functions as a diaphragm element.

The core material will transfer outer pressure as pure compressive stress.

The core material can be adapted to the actual, local loads. For areas exposed to, for example, shock loads such as desludging/explosion loads a cushioning/resilient core material can be used in order to avoid high peak loads in the supporting parts of the construction.

The outer skin or the outer laminate can be built up primarily to tolerate local shock loads.

With the new arrangement according to the invention, problems of buckling and delaminating on compressive stress in the laminate plane are avoided. The material in the inner skin can be used up towards maximum tensile stress, which is much higher than permitted compressive stress. This gives rise to reduced weight. The bearing of forces against the diaphragm section makes small demands on levels of tolerance in the construction of the inner laminate or the inner skin.

As the core material transfers outer pressure as pure compressive stress, there is no special requirement for great shearing strength in the core material. The danger of shearing fractures in the core material has therefore almost been eliminated. The specific weight of the core material can thus be reduced.

As the outer skin can be constructed primarily to tolerate local shock loads, the danger of delamination due to overloading (shearing fractures/local buckling) can be virtually eliminated. Local damage from floating objects, or the like, will not effect the strength of the hull. Local damage of this kind can easily be repaired without any demands on the strength in the repaired outer layer/core material.

It will be understood that the inner skin, which bears outer loads, will be well-protected against damage because the diaphragm element lies inside the hull, protected by the outer skin and core.

An interesting construction is achieved if, as according to the invention, the inner skin formed as a diaphragm element and the primary bending stressed outer skin lie with direct reciprocal fixed contact in the contact area against the longitudinal stiffeners in the framework.

The special advantage in a structural embodiment of this kind is that there is a joint action between the diaphragm element and the adjacent outer skin(s) (on the other side of the respective longitudinal stiffeners), so that tensile stress in the inner skin is advantageously transferred to the adjacent outer skin.

BRIEF DESCRIPTION OF THE DRAWINGS

The invention shall now be described in more detail with reference to the drawings, wherein.

DETAILED DESCRIPTION

Figure 1:
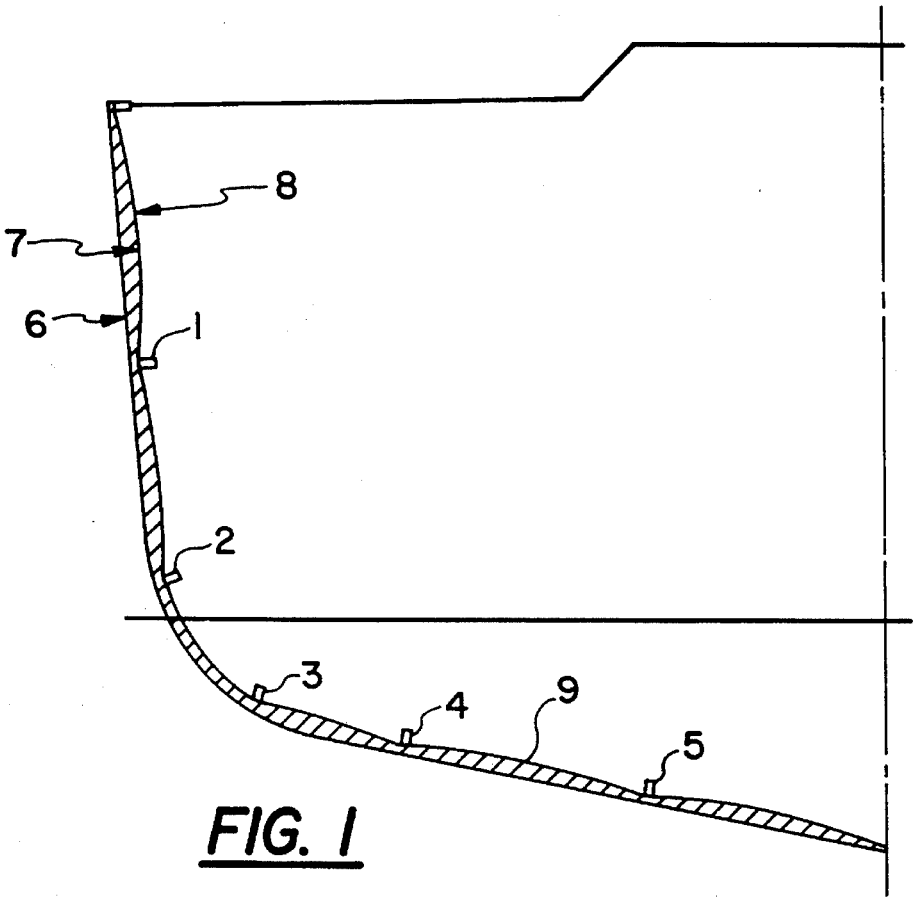
FIG. 1 shows a half section through a vessel constructed according to the invention.

In FIG. 1, the invention shown is used on a single hull, in this case a small, fast-moving vessel, e.g., a patrol boat. The figure shows a half section from the midsection of the hull. The construction of the hull comprises longitudinal ribs or stiffeners 1–5. The construction also comprises transverse stiffeners or ribs on the inside of the longitudinal stiffeners, deck beams, and possibly also bottom beams, etc., but these known frame elements, per se, in a hull of a vessel are not shown.

The skin plate of the vessel is built up in a sandwich construction, with an outer skin 6, a core 7 and an inner skin 8. The inner skin is constructed as a diaphragm section between the longitudinal stiffeners, i.e., seen from the outer side concave plate sections, see for instance, plate section 9 between the ribs 4 and 5 which run in the fore-and-aft direction. As shown in FIG. 1, concave plate sections of this kind are formed between each pair of adjacent fore-and-aft ribs. One exception is between the fore-and-aft ribs 2 and 3 in the area of the bilge, where in the shown construction there is a conventional curvature of the sandwich material.

The outer skin 6 has a conventional plate form, i.e., it follows a customary framework for a smooth hull form.

Figure 2:
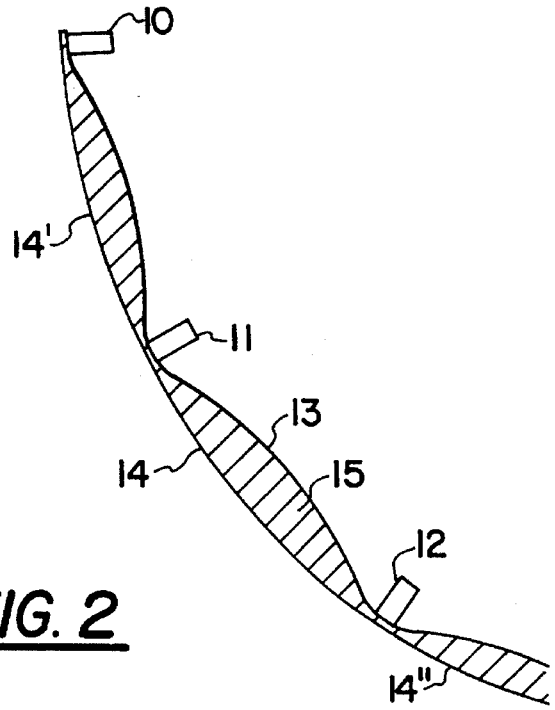
FIG. 2 shows a cross-section of a modified skin section according to the invention.

Also in FIG. 2, the sandwich skin plate is built up in such a way that between the longitudinal stiffeners 10,11,12 a concave plate section is formed by the inner skin 13. These concave plate sections extend in the same way as in the embodiment in FIG. 1 continuously from bow to stern. In the embodiment in FIG. 2 as in FIG. 1, the outer skin 14 is given a conventional curvature, i.e., it follows an even and smooth framework.

In FIG. 1, the core material 7 is present between the inner skin and the outer skin the whole way, also in the areas by the longitudinal stiffeners, but in FIG. 2 the core material 15 is omitted over the longitudinal stiffeners 10,11,12, and therefore the inner skin 13, which functions as a diaphragm, and the primary bending stressed outer skin 14 there lie in direct contact with one another. In the embodiment shown in FIG. 2, tensile stress in the inner skin will therefore be transferred, in an advantageous manner, to the the adjacent outer skin(s), i.e., the tensile stress in the inner skin 13 will, in a manner which is advantageous, be transferred to the adjacent outer skin sections 14' and 14" because inner skin and outer skin at the longitudinal stiffeners 11,12 lie in direct contact with one another in fixed reciprocal contact.

One can see by making a study of the drawings, than the outer load (distributed pressure) is borne by the tensile stress in the inner diaphragm. Problems with bulking and delamination on compressire stress are avoided. The material can thereby be used up towards maximum tensile stress, which is much higher than allowed compressive stress. This gives rise to reduced weight. The bearing forces against the diaphragm section makes small demands on tolerance in the building up of the inner laminate or skin.

The core material will transfer pressure as pure compressive stress. This therefore makes only small, or even no demands for the great shearing strength in the core material, and the danger of shearing fractures in the core material is avoided. The specific weight of the core material can thus be reduced.

The outer skin or outer laminate can be built, up primarily to tolerate local shock loads. The risk of delamination because of overloading (shearing fracture/local bulking) is eliminated. Local damage from floating objects, or the like, will not effect the strength of the hull. Local damage of this kind can easily be repaired without any demands on the strength of the repaired outer layer/core material. The inner skin or the inner laminate which bears outer loads is well-protected against damage.

The use of the diaphragm effect entails the transverse ribs (not shown) not needing to lie in contact with the skin. This gives rise to possibilities for straight ribs and use of standardized hull elements.

In the construction of a hull, materials that can be used in the inner skin are composite materials based on glass fiber, carbon fiber, Kevlar® and the like. The outer skin could possibly be constructed of a robust substance such as, for example, glass fiber-reinforced polyester with suitable fiber orientation or Kevlar, or similar.

As an alternative hybrid solution, the inner hull (skin) with stiffening could be made of metal (aluminum). The core material is glued on (possibly sprayed on) and the outer skin is placed on as an ordinary laminate in a suitable composite material. The construction would now appear to be a plastic hull from the outside but would look like an aluminum hull from the inside. This can, in certain cases, have advantages in terms of production and strength (protection of thin aluminum diaphragms).

The invention can, as a person skilled in the art will see, be achieved in combination with the prior art, for example, conventional laminate methods. As mentioned, a skin plate can be perceived as a plate area between two longitudinal stiffeners, and also as a larger plate area which extends over several longitudinal stiffeners.

We claim:

1. A vessel hull, comprising:

a framework of stiffening elements collectively having an outer side; and a skin plate covering said outer side of said framework;

said skin plate being a laminar composite structure including an outer skin and an inner skin respectively provided on opposite faces of an inner core;

said skin plate having a tensile strength presenting resistance to external water pressure by means of a diaphragm effect that is primarily provided by said inner skin;

said core being made of a stress-absorptive material, and said outer skin being resistant to lateral stress, for providing said hull with protection against localized mechanical shock when in use.

2. The vessel hull of claim 1, wherein:

said framework, on said outer side thereof, is applied in direct, fixed contact, throughout a mutual interfacial contact area, with said inner skin of said skin plate.

3. The vessel hull of claim 2, wherein:

said inner skin is made of aluminum; and said outer skin is made of a fiber-reinforced synthetic plastic material.

4. The vessel hull of claim 2, wherein:

said inner skin is made of a fiber-reinforced composite material, wherein the fiber is selected from the group consisting of glass fiber, carbon fiber and polyaramid fiber woven to provide a fabric; and said outer skin is made of a fiber-reinforced synthetic plastic material.

5. The vessel hull of claim 1, wherein:

said stress-absorptive material of said core, is resilient, for shape recovery after occurrence of an event of stress application to said vessel hull from externally of said vessel hull.

* * * * *